US010366695B2

(12) United States Patent
Atti et al.

(10) Patent No.: US 10,366,695 B2
(45) Date of Patent: Jul. 30, 2019

(54) INTER-CHANNEL PHASE DIFFERENCE PARAMETER MODIFICATION

(71) Applicant: QUALCOMM Incorporated, San Diego, CA (US)

(72) Inventors: Venkatraman Atti, San Diego, CA (US); Venkata Subrahmanyam Chandra Sekhar Chebiyyam, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/836,618

(22) Filed: Dec. 8, 2017

(65) Prior Publication Data

US 2018/0204579 A1 Jul. 19, 2018

Related U.S. Application Data

(60) Provisional application No. 62/448,297, filed on Jan. 19, 2017.

(51) Int. Cl.

| | |
|---|---|
| ***G10L 19/008*** | (2013.01) |
| ***H04R 5/02*** | (2006.01) |
| ***H04S 3/00*** | (2006.01) |

(52) U.S. Cl.

CPC ..... *G10L 19/008* (2013.01); *H04R 5/02* (2013.01); *H04S 3/008* (2013.01); *H04S 2420/03* (2013.01)

(58) Field of Classification Search

CPC ... G10L 19/008; H04S 2420/03; H04S 3/008; H04R 5/02

USPC ..... 381/22, 23

See application file for complete search history.

(56) References Cited

U.S. PATENT DOCUMENTS

2010/0241436 A1* 9/2010 Kim ..... G10L 19/008 704/500

FOREIGN PATENT DOCUMENTS

WO 2010097748 A1 9/2010

OTHER PUBLICATIONS

Breebaart J., et al., "Parametric Coding of Stereo Audio", EURASIP Journal on Applied Signal Processing 2005:9, pp. 1305-1322.

International Search Report and Written Opinion—PCT/US2017/065547—ISA/EPO—dated Feb. 16, 2018.

* cited by examiner

*Primary Examiner* — Paul Kim

(74) *Attorney, Agent, or Firm* — Toler Law Group, P.C.

(57) ABSTRACT

A method includes performing modifying, at a decoder, at least a portion of inter-channel phase difference (IPD) parameter values based on a mismatch value to generate modified IPD parameter values. The mismatch value is indicative of an amount of temporal misalignment between an encoder-side reference channel and an encoder-side target channel. The modified IPD parameter values are applied to a decoded frequency-domain mid channel during an up-mix operation.

35 Claims, 7 Drawing Sheets

INTER-CHANNEL PHASE DIFFERENCE PARAMETER MODIFICATION

I. CROSS REFERENCE TO RELATED APPLICATIONS

The present application claims the benefit of U.S. Provisional Patent Application No. 62/448,297, entitled "MULTIPLE SIGNAL CODING AND INTER-CHANNEL PARAMETER MODIFICATION," filed Jan. 19, 2017, which is expressly incorporated by reference herein in its entirety.

II. FIELD

The present disclosure is generally related to encoding of multiple audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include or be coupled to multiple microphones to receive audio signals. Generally, a sound source is closer to a first microphone than to a second microphone of the multiple microphones. Accordingly, a second audio signal received from the second microphone may be delayed relative to a first audio signal received from the first microphone due to the respective distances of the microphones from the sound source. In other implementations, the first audio signal may be delayed with respect to the second audio signal. In stereo-encoding, audio signals from the microphones may be encoded to generate a mid channel signal and one or more side channel signals. The mid channel signal may correspond to a sum of the first audio signal and the second audio signal. A side channel signal may correspond to a difference between the first audio signal and the second audio signal. The first audio signal may not be aligned with the second audio signal because of the delay in receiving the second audio signal relative to the first audio signal. The misalignment of the first audio signal relative to the second audio signal may increase the difference between the two audio signals. Because of the increase in the difference, phase differences between frequency-domain versions of the audio signals may become less relevant.

IV. SUMMARY

In a particular implementation, a device includes a receiver configured to receive an encoded bitstream that includes an encoded mid channel and stereo parameters. The stereo parameters include inter-channel phase difference (IPD) parameter values and a mismatch value indicative of an amount of temporal misalignment between an encoder-side reference channel and an encoder-side target channel. The device also includes a mid channel decoder configured to decode the encoded mid channel to generate a decoded mid channel. The device further includes a transform unit configured to perform a transform operation on the decoded mid channel to generate a decoded frequency-domain mid channel. The device also includes a stereo parameter adjustment unit configured to modify at least a portion of the IPD parameter values based on the mismatch value to generate modified IPD parameter values. The device also includes an up-mixer configured to perform an up-mix operation on the decoded frequency-domain mid channel to generate a frequency-domain left channel and a frequency-domain right channel. The modified IPD parameter values are applied to the decoded frequency-domain mid channel during the up-mix operation. The device also includes a first inverse transform unit configured to perform a first inverse transform operation on frequency-domain left channel to generate a time-domain left channel. The device further includes a second inverse transform unit configured to perform a second inverse transform operation on the frequency-domain right channel to generate a time-domain right channel.

In another particular implementation, a method of decoding audio channels includes receiving, at a decoder, an encoded bitstream that includes an encoded mid channel and stereo parameters. The stereo parameters include inter-channel phase difference (IPD) parameter values and a mismatch value indicative of an amount of temporal misalignment between an encoder-side reference channel and an encoder-side target channel. The method also includes decoding the encoded mid channel to generate a decoded mid channel and performing a transform operation on the decoded mid channel to generate a decoded frequency-domain mid channel. The method further includes modifying at least a portion of the IPD parameter values based on the mismatch value to generate modified IPD parameter values. The method also includes performing an up-mix operation on the decoded frequency-domain mid channel to generate a frequency-domain left channel and a frequency-domain right channel. The modified IPD parameter values are applied to the decoded frequency-domain mid channel during the up-mix operation. The method further includes performing a first inverse transform operation on frequency-domain left channel to generate a time-domain left channel and performing a second inverse transform operation on the frequency-domain right channel to generate a time-domain right channel.

In another particular implementation, a non-transitory computer-readable medium includes instructions that, when executed by a processor within a decoder, cause the processor to perform operations including decoding an encoded mid channel to generate a decoded mid channel. The encoded mid channel is included in an encoded bitstream received by the decoder. The encoded bitstream further includes stereo parameters that include inter-channel phase difference (IPD) parameter values and a mismatch value indicative of an amount of temporal misalignment between an encoder-side reference channel and an encoder-side target channel. The operations also include performing a transform operation on the decoded mid channel to generate a decoded frequency-domain mid channel. The operations also include modifying at least a portion of the IPD parameter values based on the mismatch value to generate modified IPD parameter values. The operations also include performing an up-mix operation on the decoded frequency-domain mid channel to generate a frequency-domain left channel and a frequency-domain right channel. The modified IPD parameter values are applied to the decoded frequency-domain mid channel during the up-mix operation. The operations also include performing a first inverse transform operation on frequency-domain left channel to generate a time-domain left channel and performing a second inverse transform operation on the frequency-domain right channel to generate a time-domain right channel.

In another particular implementation, an apparatus includes means for receiving an encoded bitstream that includes an encoded mid channel and stereo parameters. The stereo parameters include inter-channel phase difference (IPD) parameter values and a mismatch value indicative of an amount of temporal misalignment between an encoder-side reference channel and an encoder-side target channel. The apparatus also includes means for decoding the encoded mid channel to generate a decoded mid channel and means for performing a transform operation on the decoded mid channel to generate a decoded frequency-domain mid channel. The apparatus further includes means for modifying at least a portion of the IPD parameter values based on the mismatch value to generate modified IPD parameter values. The apparatus also includes means for performing an up-mix operation on the decoded frequency-domain mid channel to generate a frequency-domain left channel and a frequency-domain right channel. The modified IPD parameter values are applied to the decoded frequency-domain mid channel during the up-mix operation. The apparatus further includes means for performing a first inverse transform operation on frequency-domain left channel to generate a time-domain left channel and means for performing a second inverse transform operation on the frequency-domain right channel to generate a time-domain right channel.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
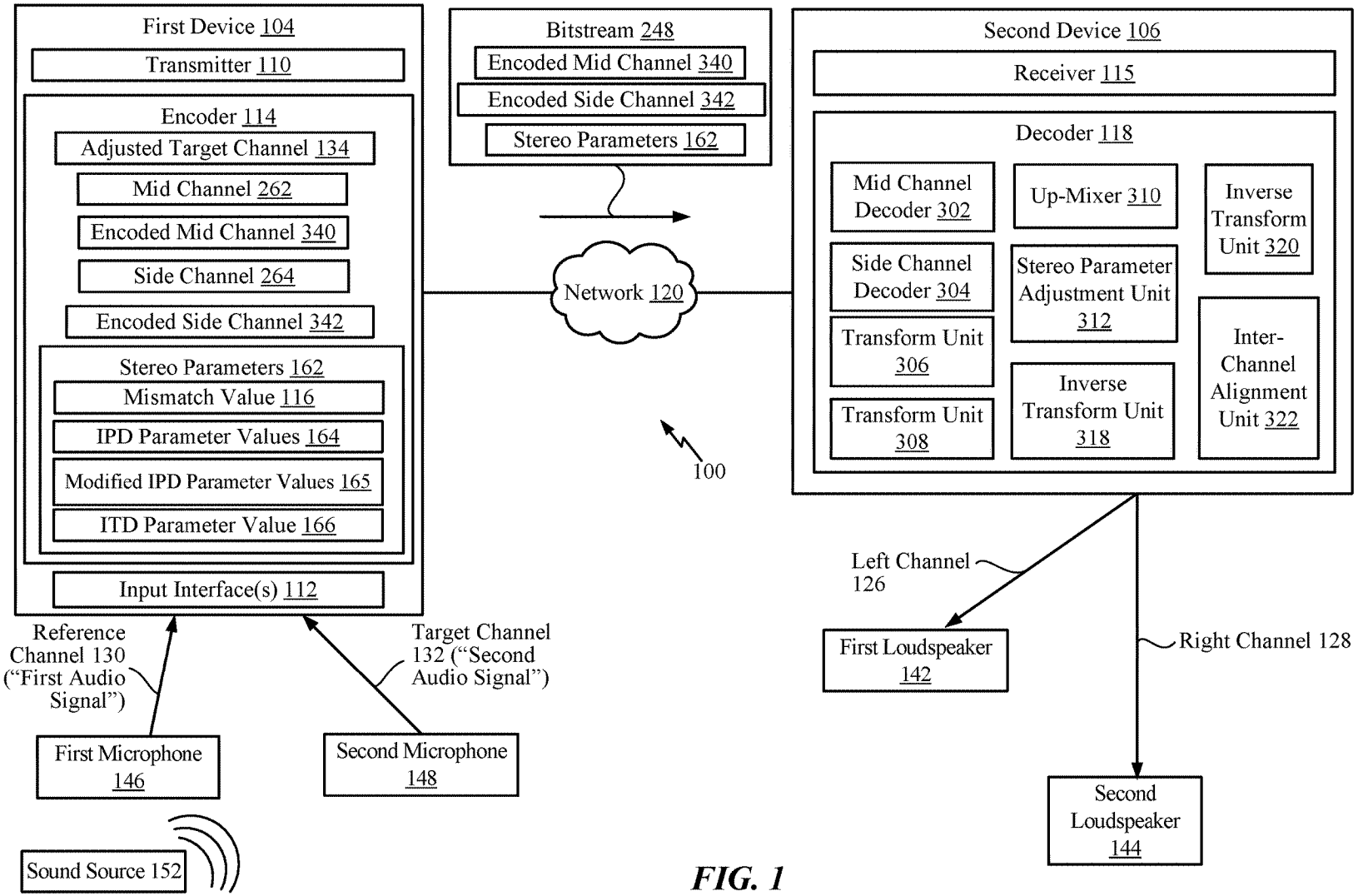
FIG. 1 is a block diagram of a particular illustrative example of a system that includes an encoder operable to modify inter-channel phase difference (IPD) parameters and a decoder operable to modify IPD parameters.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded or coded based on a model in MS coding. Relatively more bits are spent on the sum signal than on the side signal. PS coding reduces redundancy in each sub-band by transforming the L/R signals into a sum signal and a set of side parameters. The side parameters may indicate an inter-channel intensity difference (IID), an inter-channel phase difference (IPD), an inter-channel time difference (ITD), side or residual prediction gains, etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical. In some implementations, the PS coding may be used in the lower bands also to reduce the inter-channel redundancy before waveform coding.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),\ S=c(L-R), \qquad \text{Formula 2}$$

where c corresponds to a complex value which is frequency dependent. Generating the Mid channel and the Side channel based on Formula 1 or Formula 2 may be referred to as "downmixing". A reverse process of generating the Left channel and the Right channel from the Mid channel and the Side channel based on Formula 1 or Formula 2 may be referred to as "upmixing".

In some cases, the Mid channel may be based other formulas such as:

$$M=(L+g_D R)/2, \text{ or} \qquad \text{Formula 3}$$

$$M=g_1 L+g_2 R \qquad \text{Formula 4}$$

where $g_1+g_2=1.0$, and where $g_D$ is a gain parameter. In other examples, the downmix may be performed in bands, where $\text{mid}(b)=c_1L(b)+c_2R(b)$, where $c_1$ and $c_2$ are complex numbers, where $\text{side}(b)=c_3L(b)-c_4R(b)$, and where $c_3$ and $c_4$ are complex numbers.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value indicative of an amount of temporal misalignment between the first audio signal and the second audio signal. As used herein, a "temporal shift value", a "shift value", and a "mismatch value" may be used interchangeably. For example, the encoder may determine a temporal shift value indicative of a shift (e.g., the temporal mismatch) of the first audio signal relative to the second audio signal. The temporal mismatch value may correspond to an amount of temporal delay between receipt of the first audio signal at the first microphone and receipt of the second audio signal at the second microphone. Furthermore, the encoder may determine the temporal mismatch value on a frame-by-frame basis, e.g., based on each 20 milliseconds (ms) speech/audio frame. For example, the temporal mismatch value may correspond to an amount of time that a second frame of the second audio signal is delayed with respect to a first frame of the first audio signal. Alternatively, the temporal mismatch value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal delay value may also change from one frame to another. However, in some implementations, the temporal mismatch value may always be positive to indicate an amount of delay of the "target" channel relative to the "reference" channel. Furthermore, the temporal mismatch value may correspond to a "non-causal shift" value by which the delayed target channel is "pulled back" in time such that the target channel is aligned (e.g., maximally aligned) with the "reference" channel. The downmix algorithm to determine the mid channel and the side channel may be performed on the reference channel and the non-causal shifted target channel.

The encoder may determine the temporal mismatch value based on the reference audio channel and a plurality of temporal mismatch values applied to the target audio channel. For example, a first frame of the reference audio channel, X, may be received at a first time ($m_1$). A first particular frame of the target audio channel, Y, may be received at a second time ($n_1$) corresponding to a first temporal mismatch value, e.g., shift1=$n_1-m_1$. Further, a second frame of the reference audio channel may be received at a third time ($m_2$). A second particular frame of the target audio channel may be received at a fourth time ($n_2$) corresponding to a second temporal mismatch value, e.g., shift2=$n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a temporal mismatch value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally misaligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, where there are more than two channels, a reference channel is initially selected based on the levels or energies of the channels, and subsequently refined based on the temporal mismatch values between different pairs of the channels, e.g., t1(ref, ch2), t2(ref, ch3), t3(ref, ch4), . . . t3(ref, chN), where ch1 is the ref channel initially and t1(.), t2(.), etc. are the functions to estimate the mismatch values. If all temporal mismatch values are positive then ch1 is treated as the reference channel. If any of the mismatch values is a negative value, then the reference channel is reconfigured to the channel that was associated with a mismatch value that resulted in a negative value and the above process is continued until the best selection (i.e., based on maximally decorrelating maximum number of side channels) of the reference channel is achieved. A hysteresis may be used to overcome any sudden variations in reference channel selection.

In some examples, a time of arrival of audio signals at the microphones from multiple sound sources (e.g., talkers) may vary when the multiple talkers are alternatively talking (e.g., without overlap). In such a case, the encoder may dynamically adjust a temporal mismatch value based on the talker to identify the reference channel. In some other examples, the multiple talkers may be talking at the same time, which may result in varying temporal mismatch values depending on who is the loudest talker, closest to the microphone, etc. In such a case, identification of reference and target channels may be based on the varying temporal shift values in the current frame and the estimated temporal mismatch values in the previous frames, and based on the energy or temporal evolution of the first and second audio signals.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular temporal mismatch value. The encoder may generate a first estimated temporal mismatch value based on the comparison values. For example, the first estimated temporal mismatch value may correspond to a comparison value indicating a higher temporal-similarity (or lower difference) between the first frame of the first audio signal and a corresponding first frame of the second audio signal.

The encoder may determine a final temporal mismatch value by refining, in multiple stages, a series of estimated temporal mismatch values. For example, the encoder may first estimate a "tentative" temporal mismatch value based on comparison values generated from stereo pre-processed and re-sampled versions of the first audio signal and the second audio signal. The encoder may generate interpolated comparison values associated with temporal mismatch values proximate to the estimated "tentative" temporal mismatch value. The encoder may determine a second estimated "interpolated" temporal mismatch value based on the interpolated comparison values. For example, the second estimated "interpolated" temporal mismatch value may correspond to a particular interpolated comparison value that indicates a higher temporal-similarity (or lower difference) than the remaining interpolated comparison values and the first estimated "tentative" temporal mismatch value. If the second estimated "interpolated" temporal mismatch value of the current frame (e.g., the first frame of the first audio signal) is different than a final temporal mismatch value of a previous frame (e.g., a frame of the first audio signal that precedes the first frame), then the "interpolated" temporal mismatch value of the current frame is further "amended" to improve the temporal-similarity between the first audio signal and the shifted second audio signal. In particular, a third estimated "amended" temporal mismatch value may correspond to a more accurate measure of temporal-similarity by searching around the second estimated "interpolated" temporal mismatch value of the current frame and the final estimated temporal mismatch value of the previous frame. The third estimated "amended" temporal mismatch value is further conditioned to estimate the final temporal mismatch value by limiting any spurious changes in the temporal mismatch value between frames and further controlled to not switch from a negative temporal mismatch value to a positive temporal mismatch value (or vice versa) in two successive (or consecutive) frames as described herein.

In some examples, the encoder may refrain from switching between a positive temporal mismatch value and a negative temporal mismatch value or vice-versa in consecutive frames or in adjacent frames. For example, the encoder may set the final temporal mismatch value to a particular value (e.g., 0) indicating no temporal-shift based on the estimated "interpolated" or "amended" temporal mismatch value of the first frame and a corresponding estimated "interpolated" or "amended" or final temporal mismatch value in a particular frame that precedes the first frame. To illustrate, the encoder may set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is positive and the other of the estimated "tentative" or "interpolated" or "amended" or "final" estimated temporal mismatch value of the previous frame (e.g., the frame preceding the first frame) is negative. Alternatively, the encoder may also set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is negative and the other of the estimated "tentative" or "interpolated" or "amended" or "final" estimated temporal mismatch value of the previous frame (e.g., the frame preceding the first frame) is positive.

The encoder may select a frame of the first audio signal or the second audio signal as a "reference" or "target" based on the temporal mismatch value. For example, in response to determining that the final temporal mismatch value is positive, the encoder may generate a reference channel or signal indicator having a first value (e.g., 0) indicating that the first audio signal is a "reference" signal and that the second audio signal is the "target" signal. Alternatively, in response to determining that the final temporal mismatch value is negative, the encoder may generate the reference channel or signal indicator having a second value (e.g., 1) indicating that the second audio signal is the "reference" signal and that the first audio signal is the "target" signal.

The encoder may estimate a relative gain (e.g., a relative gain parameter) associated with the reference signal and the non-causal shifted target signal. For example, in response to determining that the final temporal mismatch value is positive, the encoder may estimate a gain value to normalize or equalize the amplitude or power levels of the first audio signal relative to the second audio signal that is offset by the non-causal temporal mismatch value (e.g., an absolute value of the final temporal mismatch value). Alternatively, in response to determining that the final temporal mismatch value is negative, the encoder may estimate a gain value to normalize or equalize the power or amplitude levels of the non-causal shifted first audio signal relative to the second audio signal. In some examples, the encoder may estimate a gain value to normalize or equalize the amplitude or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal, the non-causal temporal mismatch value, and the relative gain parameter. In other implementations, the encoder may generate at least one encoded signal (e.g., a mid channel, a side channel, or both) based on the reference channel and the temporal-mismatch adjusted target channel. The side signal may correspond to a difference between first samples of the first frame of the first audio signal and selected samples of a selected frame of the second audio signal. The encoder may select the selected frame based on the final temporal mismatch value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal temporal mismatch value, the relative gain parameter, the reference channel or signal indicator, or a combination thereof.

The encoder may generate at least one encoded signal (e.g., a mid signal, a side signal, or both) based on the reference signal, the target signal, the non-causal temporal mismatch value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal temporal mismatch value and inter-channel relative gain parameter. The low band parameters, the high band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal temporal mismatch value, the relative gain parameter, the reference channel (or signal) indicator, or a combination thereof. In the present disclosure, terms such as "determining", "calculating", "shifting", "adjusting", etc. may be used to describe how one or more operations are performed. It should be noted that such terms are not to be construed as limiting and other techniques may be utilized to perform similar operations.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 includes an encoder 114, a transmitter 110, and one or more input interfaces 112. A first input interface of the input interfaces 112 is coupled to a first microphone 146, and a second input interface of the input interfaces 112 is coupled to a second microphone 148. A non-limiting example of an architecture of the encoder 114 is described with respect to FIG. 2. The second device 106 includes a receiver 115 and a decoder 118. A non-limiting example of an architecture of the decoder 118 is described with respect to FIG. 3. The second device 106 is coupled to a first loudspeaker 142 and coupled to a second loudspeaker 144.

During operation, the first device 104 receives a reference channel 130 (e.g., a first audio signal) via the first input interface from the first microphone 146 and receives a target channel 132 (e.g., a second audio signal) via the second input interface from the second microphone 148. The reference channel 130 corresponds to one of a left channel or a right channel, and the target channel 132 corresponds to the other of the left channel or the right channel. A sound source 152 (e.g., a user, a speaker, ambient noise, a musical instrument, etc.) may be closer to the first microphone 146 than to the second microphone 148. Accordingly, an audio signal from the sound source 152 may be received at the input interfaces 112 via the first microphone 146 at an earlier time than via the second microphone 148. This natural delay in the multi-channel signal acquisition through the multiple microphones may introduce a temporal misalignment between the reference channel 130 and the target channel 132. Accordingly, the target channel 132 may be adjusted (e.g., temporally shifted) to substantially align with the reference channel 130.

The encoder 114 is configured to determine a mismatch value 116 (e.g., a non-causal shift value) indicative of an amount of a temporal misalignment between the reference channel 130 and the target channel 132. According to one implementation, the mismatch value 116 indicates the amount of temporal misalignment in the time domain. According to another implementation, the mismatch value 116 indicates the amount of temporal misalignment in the frequency domain. The encoder 114 is configured to adjust the target channel 132 by the mismatch value 116 to generate an adjusted target channel 134. Because the target channel 132 is adjusted by the mismatch value 116, the adjusted target channel 134 and the reference channel 130 are substantially aligned.

The encoder 114 is configured to estimate stereo parameters 162 based on frequency-domain versions of the adjusted target channel 134 and the reference channel 130. According to one implementation, the mismatch value 116 is included in the stereo parameters 162. The stereo parameters 162 also include inter-channel phase difference (IPD) parameter values 164 and an inter-channel time difference (ITD) parameter value 166. According to one implementation, the mismatch value 116 and the ITD parameter value 166 are similar (e.g., the same value). The IPD parameter values 164 may indicate phase differences between the channels 130, 134 on a band-by-band basis.

According to one implementation, the encoder 114 modifies the IPD parameter values 164 based on the temporal mismatch value 116 to generate modified IPD parameter values 165. For example, in response to a determination that the absolute value of the mismatch value 116 satisfies a threshold, the encoder 114 may modify the IPD parameter values 164 to generate the modified IPD parameter values 165. The determination of whether to modify the IPD parameter values 164 may be based on short-term and long-term IPD values.

According to one implementation, the encoder 114 sets one or more of the IPD parameter values 164 to zero to generate the modified IPD parameter values 165. According to another implementation, the encoder 114 temporally smoothes one or more of the IPD parameter values 164 to generate the modified IPD parameter values 165.

To illustrate, the encoder 114 may determine IPD information based on the mismatch value 116. The IPD information may indicate how the IPD parameter values 164 are to be modified, and the IPD parameter values 164 may indicate phase differences between the frequency-domain version of the reference channel 130 and the frequency-domain version of the adjusted target channel 134 at different frequency bands (b). According to one implementation, modifying the IPD parameter values 164 includes setting one or more of the IPD parameter values 164 to zero values (or other gain values). According to another implementation, modifying the IPD parameter values 164 may include temporally smoothing one or more of the IPD parameter values 164. According to one implementation, IPD parameter values where residual coding is used (e.g., IPD parameters of lower frequency bands (b)) are modified and IPD parameter values of higher frequency bands are unchanged.

The encoder 114 may determine whether the mismatch value 116 satisfies a first mismatch threshold (e.g., an upper mismatch threshold). If the encoder 114 determines that the mismatch value 116 satisfies (e.g., is greater than) the first mismatch threshold, the encoder 114 is be configured to modify the IPD parameter values 164 for each frequency band (b) associated with the frequency-domain version of the adjusted target channel 134. Thus, if the temporal misalignment between the channels 130, 132 is large (e.g., greater than the first mismatch threshold), shifting the target channel 132 to improve temporal alignment of the target and reference channels 130, 132 can cause the IPD parameter values generated after shifting to have a large variation from one frame to the next. For example, the temporal shift of the target channel 132 may shift the target channel 132 much greater than a temporal distance that can be indicated by the IPD parameter values 164. To illustrate, the IPD parameter values 164 can indicate values from a range of negative pi to pi. However, the temporal shift may be larger than the range. Thus, the encoder 114 may determine that the IPD parameter values 164 are not of particular relevance if the mismatch value 116 is greater than the first mismatch threshold. As a result, the IPD parameter values 164 may be set to zero values (or temporally smoothed over several frames).

The encoder 114 may also determine whether the mismatch value 116 satisfies a second mismatch threshold (e.g., a lower mismatch threshold). If the encoder 114 determines that the mismatch value 116 fails to satisfy (e.g., is less than) the second mismatch threshold, the encoder 114 is configured to bypass modification of the IPD parameter values 164. Thus, if the temporal misalignment between the channels 130, 132 is small (e.g., less than the second mismatch threshold), shifting the target channel 132 to improve temporal alignment of the target and reference channels 130, 132 can cause the IPD parameter values 164 generated after shifting to have a small variation from one frame to the next. As a result, the variation indicated by the IPD parameter values 164 may be of greater significance and IPD parameter values 164 for each frequency band (b) may remain unchanged.

The encoder 114 may modify IPD parameter values 164 for a subset of frequency bands (b) associated with the frequency-domain version of the target channel 132 in response to a first determination that the mismatch value 116 fails to satisfy the first mismatch threshold and in response to a determination that the mismatch value 116 satisfies the second mismatch threshold. According to one implementation, the IPD parameter values 164 may be modified (e.g., set to zero or temporally smoothed) for frequency bands (b) associated with residual coding in response to the mismatch value 116 failing to satisfy the first mismatch threshold and satisfying the second mismatch threshold. According to another implementation, IPD parameter values 164 for select frequency bands (b) may be modified in response to the mismatch value 116 failing to satisfy the first mismatch threshold and satisfying the second mismatch threshold.

The encoder 114 is configured to perform an up-mix operation on the adjusted target channel 134 (or a frequency-domain version of the adjusted target channel 134) and the reference channel 130 (or a frequency-domain version of the reference channel 130) using the IPD parameter values 164, the modified IPD parameter values 165, etc. For example, the encoder 114 may generate a mid channel 262 and a side channel 264 based, at least partially on, the up-mix operation. Generation of the mid channel 262 and the side channel 264 is described in greater detail with respect to FIG. 2. The encoder 114 is further configured to encode the mid channel 262 to generate an encoded mid channel 340, and the encoder is configured to encode the side channel 264 to generate the encoded side channel 342.

A bitstream 248 (e.g., an encoded bitstream) includes the encoded mid channel 340, the encoded side channel 342, and the stereo parameters 162. According to one implementation, the modified IPD parameter values 165 are not included in the bitstream 248, and the decoder 118 adjusts the IPD parameter values 164 to generate modified IPD parameter values (as described with respect to FIG. 3). According to another implementation, the modified IPD parameter values 165 are included in the bitstream 248. The transmitter 110 is configured to transmit the bitstream 248, via the network 120, to the second device 106.

The receiver 115 is configured to receive the bitstream 248. As described with respect to FIG. 3, the decoder 118 is configured to perform decoding operations components of the bitstream 248 to generate a left channel 126 and a right channel 128. One or more speakers are configured to output the left channel 126 and the right channel 128. For example, the second device 106 may output the left channel 126 via the first loudspeaker 142, and the second device 106 may output the right channel 128 via the second loudspeaker 144. In alternative examples, the left channel 126 and the right channel 128 may be transmitted as a stereo signal pair to a single output loudspeaker.

The system 100 may modify IPD parameters based on the mismatch value 116 to reduce artifacts during decoding stages. For example, to reduce introduction of artifacts that may be caused by decoding IPD parameter values that do not include relevant information, the encoder 114 may generate IPD information (e.g., one or more flags, IPD parameter values with a pre-defined pattern, IPD parameter values set to zero in low bands) that indicates whether the encoder 114 should modify (e.g., temporally smooth) IPD parameters, indicates which IPD parameters to modify, etc.

Figure 2:
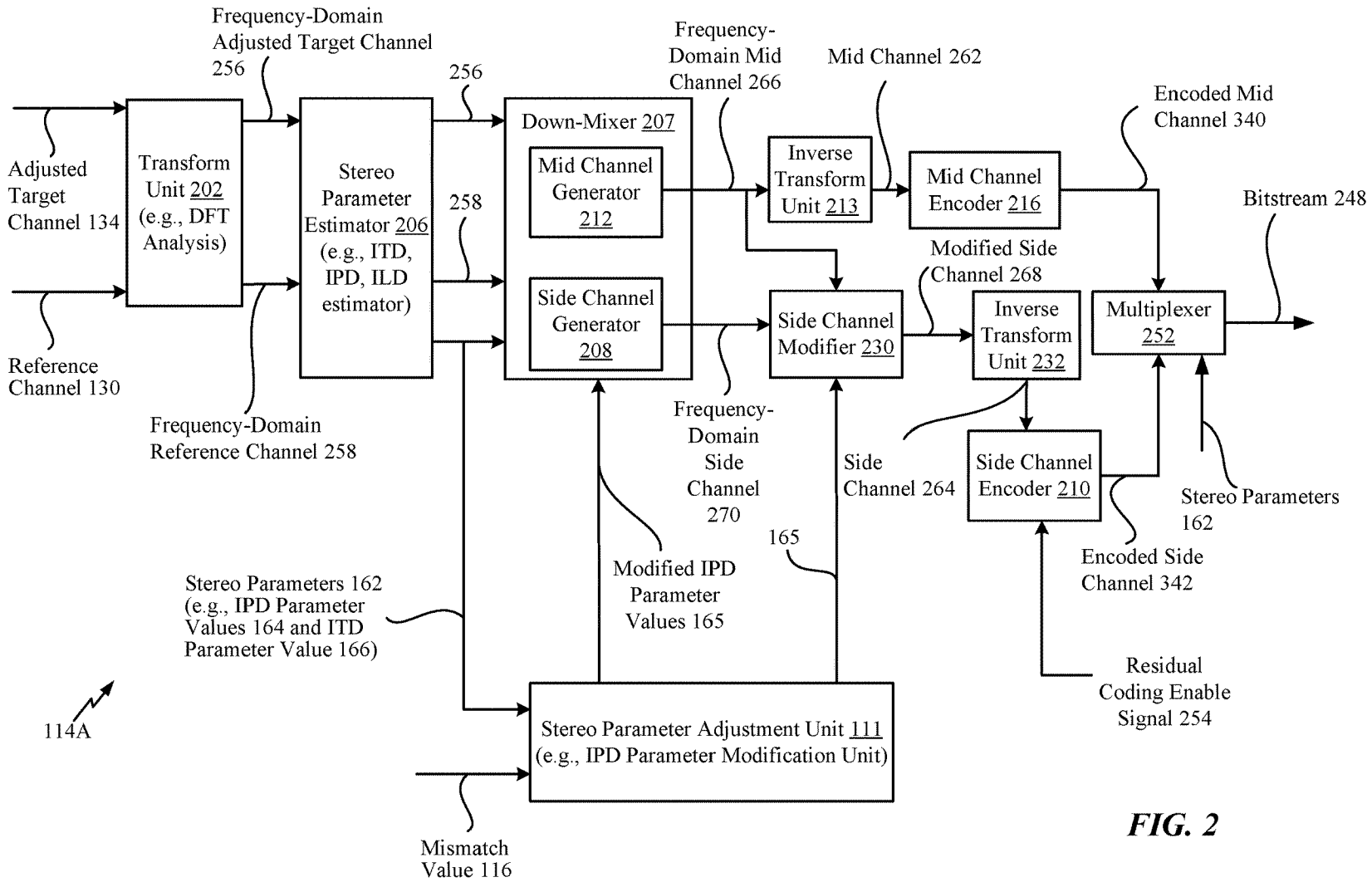
FIG. 2 is a diagram illustrating an example of the encoder of FIG. 1.

Referring to FIG. 2, a diagram illustrating a particular implementation of an encoder 114A is shown. The encoder 114A may correspond to the encoder 114 of FIG. 1. The encoder 114A includes a transform unit 202, a stereo parameter estimator 206, a down-mixer, a stereo parameter adjustment unit 11, an inverse transform unit 213, a mid channel encoder 216, a side channel encoder 210, a side channel modifier 230, an inverse transform unit 232, and a multiplexer 252.

The reference channel 130 and the adjusted target channel 134 are provided to the transform unit 202. The adjusted target channel 134 is generated by shifting (e.g., non-causally shifting) the target channel 132 by the mismatch value 116. The encoder 114A may determine whether to perform a temporal-shift operation on the target channel 132 based on the mismatch value 116 and may determine a coding mode to generate the adjusted target channel 134. In some implementations, if the mismatch value 116 is not used to temporally shift the target channel 132, then the adjusted target channel 134 may be same as that of the target channel 132.

The transform unit 202 is configured to perform a first transform operation on the reference channel 130 to generate a frequency-domain reference channel 258, and the transform unit 202 is configured to perform a second transform operation on the adjusted target channel 134 to generate a frequency-domain adjusted target channel 256. The transform operations may include Discrete Fourier Transform (DFT) operations, Fast Fourier Transform (FFT) operations, etc. According to some implementations, Quadrature Mirror Filterbank (QMF) operations (using filterbands, such as a Complex Low Delay Filter Bank) may be used to split input signals (e.g., the reference channel 130 and the adjusted target channel 134) into multiple sub-bands. The encoder 114A may be configured to determine whether to perform a second temporal-shift (e.g., non-causal) operation on the frequency-domain adjusted target channel 256 in the transform domain based on the first temporal-shift operation to generate a modified version of the frequency-domain adjusted target channel 256.

The frequency-domain reference channel 258 and the frequency-domain adjusted target channel 256 are provided to the stereo parameter estimator 206. The stereo parameter estimator 206 is configured to extract (e.g., generate) the stereo parameters 162 based on the frequency-domain reference channel 258 and the frequency-domain adjusted target channel 256. To illustrate, IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated and transmitted at an encoder may provide an estimate of the phase difference in the frequency-domain between the left and right channels in the band (b). The stereo parameters 162 may include additional (or alternative) parameters, such as ICCs, ITDs etc. The stereo parameters 162 may be transmitted to the second device 106 of FIG. 1 and may be provided to the down-mixer 207. The down-mixer 207 includes a mid channel generator 212 and a side channel generator 208. In some implementations, the stereo parameters 162 are provided to the side channel encoder 210.

The stereo parameters 162 are also provided to the stereo parameter adjustment unit 111. The stereo parameter adjustment unit 111 is configured to modify the IPD parameter values 164 (e.g., the stereo parameters 162) based on the mismatch value 116 to generate the modified IPD parameter values 165. Additionally or alternatively, the stereo parameter adjustment unit 111 is configured to determine a residual gain (e.g., a residual gain value) to be applied to a residual channel (e.g., the side channel 264). In some implementations, the stereo parameter adjustment unit 111 may also determine a value of an IPD flag (not shown). A value of the IPD flag indicates whether or not IPD parameter values for one or more bands are to be disregarded or zeroed. For example, IPD parameter values for one or more bands may be disregarded or zeroed when the IPD flag is asserted. The stereo parameter adjustment unit 111 may provide the IPD information (e.g., the modified IPD parameter values 165, the IPD parameter values 164, the IPD flag, or a combination thereof) to the down-mixer 207 (e.g., the side channel generator 208) and to the side channel modifier 230.

The frequency-domain reference channel 258 and the frequency-domain adjusted target channel 256 are provided to the down-mixer 207. According to some implementations, the stereo parameters 162 are provided to the mid channel generator 212. The mid channel generator 212 of the down-mixer 207 is configured to generate a frequency-domain mid channel $M_{fr}(b)$ 266 based on the frequency-domain reference channel 258 and the frequency-domain adjusted target channel 256. According to some implementations, the frequency-domain channel 266 is generated also based on the stereo parameters 162.

The frequency-domain mid channel $M_{fr}(b)$ 266 is provided from the mid channel generator 212 to the inverse transform unit 213 (e.g., a DFT synthesizer) and to the side channel modifier 230. The inverse transform unit 213 is configured to perform an inverse transform operation on the frequency-domain mid channel 266 to generate the mid channel 262 (e.g., a time-domain mid channel). The inverse transform operation may include an Inverse Discrete Fourier Transform (IDFT) operation, an Inverse Discrete Cosine Transform (IDCT) operation, etc. According to one implementation, the inverse transform unit 213 synthesizes the frequency-domain mid channel 266 to generate the mid channel 262. The mid channel 262 is provided to the mid channel encoder 216. The mid channel encoder 216 is configured to encode the mid channel 262 to generate the encoded mid channel 340. The encoded mid channel 340 is provided to the multiplexer 252.

The side channel generator 208 of the down-mixer 207 is configured to generate a frequency-domain side channel $S_{fr}(b)$ 270 based on the frequency-domain reference channel 258, the frequency-domain adjusted target channel 256, the stereo parameters 162, and the modified IPD parameter values 165. In each band (e.g., bin) of the frequency-domain side channel 270, the gain parameter (g) may be different and may be based on the inter-channel level differences (e.g., based on the stereo parameters 162). For example, the frequency-domain side channel 270 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)). The frequency-domain side channel 270 is provided to the side channel modifier 230. The side channel modifier 230 the modified IPD parameter values 165. The side channel modifier 230 is configured to generate a modified side channel 268 (e.g., a frequency-domain modified side channel) based on the frequency-domain side channel 270, the frequency-domain mid channel 266, and the modified IPD parameter values 165.

The inverse transform unit 232 is configured to perform an inverse transform operation on the modified side channel 268 to generate the side channel 264 (e.g., a time-domain side channel). The inverse transform operation may include an IDFT operation, an IDCT operation, etc. According to one implementation, the inverse transform unit 232 synthesizes the modified side channel 268 to generate the side channel 264. The side channel 264 is provided to the side channel encoder 210. In response to a residual coding enable signal 254 activating the side channel encoder 210, the side channel encoder 210 is configured to encode the side channel 264 to generate the encoded side channel 342. If the residual coding enable signal 254 indicates that residual encoding is disabled, the side channel encoder 210 may not generate the encoded side channel 342 for one or more frequency bands.

The encoded mid channel 340, the encoded side channel 342, and the stereo parameters 162 are provided to the multiplexer 252. The multiplexer 252 is configured to generate the bitstream 248 based on the encoded mid channel 340, the encoded side channel 342, and the stereo parameters 162.

The encoder 114A may modify IPD parameters based on the mismatch value 116 to reduce artifacts during decoding stages. For example, to reduce introduction of artifacts that may be caused by decoding IPD parameter values that do not include relevant information, the encoder 114A may generate IPD information (e.g., one or more flags, IPD parameter values with a pre-defined pattern, IPD parameter values set to zero in low bands) that indicates whether the encoder 114A should modify (e.g., temporally smooth) IPD parameters, indicates which IPD parameters to modify, etc.

Figure 3:
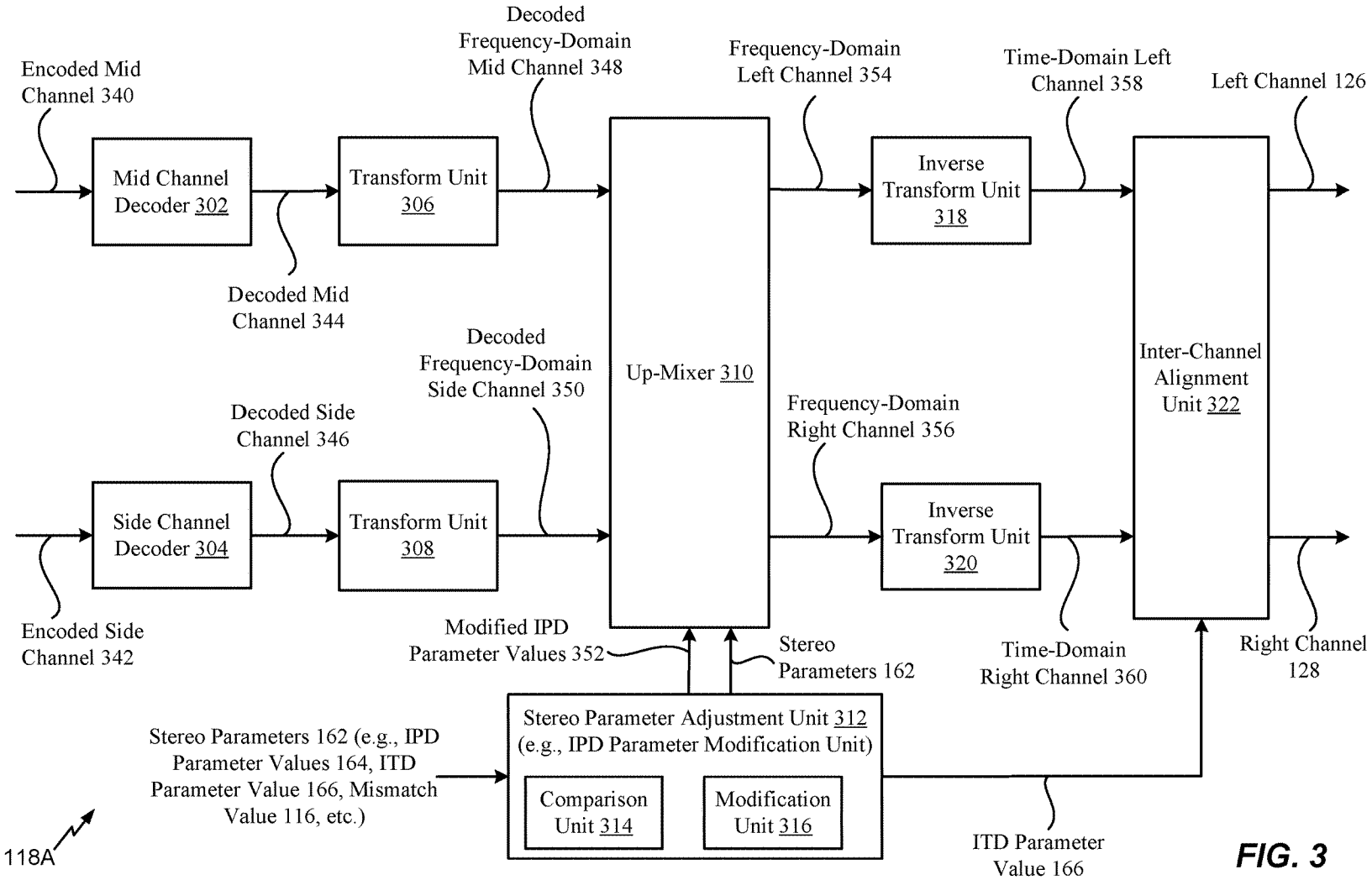
FIG. 3 is a diagram illustrating an example of the decoder of FIG. 1.

Referring to FIG. 3, a diagram illustrating a particular implementation of a decoder 118A is shown. The decoder 118A may correspond to the decoder 118 of FIG. 1. The decoder 118A includes the mid channel decoder 302, the side channel decoder 304, the transform unit 306, the transform unit 308, the up-mixer 310, the stereo parameter adjustment unit 312, the inverse transform unit 318, the inverse transform unit 320, and the inter-channel alignment unit 322.

The bitstream 248 is provided the decoder 118A, and the decoder 118A is configured to decode portions of the bitstream 248 to generate the left channel 126 and the right channel 128. The bitstream 248 includes the encoded mid channel 340, the encoded side channel 342, and the stereo parameters 162. According to one implementation, a demultiplexer (not shown) may extract the encoded mid channel 340, the encoded side channel 342, and the stereo parameters 162 from the bitstream 248. The encoded mid channel 340 is provided to the mid channel decoder 302, the encoded side channel 342 is provided to the side channel decoder 304, and the stereo parameters 162 are provided to the stereo parameter adjustment unit 312. The stereo parameters 162 include at least the IPD parameter values 164, the ITD parameter value 166, and the mismatch value 116.

The mid channel decoder 302 is configured to decode the encoded mid channel 340 to generate a decoded mid channel 344 (e.g., a time-domain mid channel $m_{CODED}(t)$). The decoded mid channel 344 is provided to the transform unit 306. The transform unit 306 is configured to perform a transform operation on the decoded mid channel 344 to generate a decoded frequency-domain mid channel 348. The transform operation may include a Discrete Cosine Transform (DCT) operation, a Discrete Fourier Transform (DFT) operation, a Fast Fourier Transform (FFT) operation, etc. The decoded frequency-domain mid channel 348 is provided to the up-mixer 310.

The side channel decoder 304 is configured to decode the encoded side channel 342 to generate a decoded side channel 346. The decoded side channel 346 is provided to the transform unit 308. The transform unit 308 is configured to perform a second transform operation on the decoded side channel 346 to generate a decoded frequency-domain side channel 350. The second transform operation may include a DCT operation, a DFT operation, an FFT operation, etc. The decoded frequency-domain side channel 350 is also provided to the up-mixer 310. Although decoding operations for the encoded side channel 342 are illustrated, in one implementation, the decoder 118A may receive an IPD flag that indicates whether or not the decoder 118A is to process or disregard residual signal information for one or more bands. Thus, decoding operations for the encoded side channel 342 may be bypassed (for one or more bands) is the IPD flag indicates to disregard residual information for the one or more bands.

The stereo parameters 162 encoded into the bitstream 248 are provided to the stereo parameter adjustment unit 312. The stereo parameter adjustment unit 312 includes a comparison unit 314 and a modification unit 316. The comparison unit 314 is configured to compare an absolute value of the mismatch value 116 to a threshold. The modification unit 316 is configured to modify at least a portion of the IPD parameters values 164 to generate modified IPD parameter values 352 in response to a determination that the absolute value of the mismatch value 116 satisfies the threshold. To illustrate, the determination of whether to modify the IPD parameter values 352 may be expressed using the following pseudocode:

```
for( b=0; b < nbands; b++ )
{
        if( b <= maxband && res_coding_Active == FALSE )
        {
                g = gLB;   /* a fixed threshold */
        }
        else
        {
                g = pSideGain[b]; /* a per-band side gain value */
        }
    if( b < ipd_band_max )
    {
            c= (1+g)/(1-g);
            if(   b < res_pred_band_min
                        && res_coding_Active == TRUE
                        && |(ITD mismatch value)| > 80.0 )
            {
                    /* modify the IPD parameters */
                    alpha = 0;
                    beta = (atan2(sin(alpha), (cos(alpha) + 2*c)));
            }
            else
            {
                    /* Don't modify the IPD parameters */
                    alpha = pIpd[b];
                    beta = (atan2(sin(alpha), (cos(alpha) + 2*c)));
            }
        }
```

As a non-limiting example, the modification unit 316 may generate the modified IPD parameter values 352 by setting one or more of the IPD parameters values 164 to zero values. As another non-limiting example, the modification unit 316 may generate the modified IPD parameter values 352 by temporally smoothing one or more of the IPD parameter values 164. The modified IPD parameter values 352 are provided to the up-mixer 310. According to one implementation, the stereo parameter adjustment unit 312 is configured to modify the IPD parameters values 164 based on an availability of the encoded side channel 342. According to another implementation, the stereo parameter adjustment unit 312 is configured to modify the IPD parameter values 164 based on a bit rate associated with the bitstream 248.

According to another implementation, the stereo parameter adjustment unit 312 is configured to modify the IPD parameter values 164 based on a voicing parameter, a packet loss determination associated with a previous frame, a speech/music classification, or another parameter. As a non-limiting example, in response to a determination that a previous frame is lost in transmission, the stereo parameter adjustment unit 312 may modify the IPD parameter values 164 to generate the modified IPD parameter values 352.

The up-mixer 310 is configured to perform an up-mix operation on the decoded frequency-domain mid channel 348 to generate a frequency-domain left channel 354 and a frequency-domain right channel 356. The modified IPD parameter values 352 and other stereo parameters 162 (e.g., ILDs, residual prediction gains, etc.) are applied to the decoded frequency-domain mid channel 348 during the up-mix operation. According to some implementations, the up-mixer 310 performs the up-mix operation on the decoded frequency-domain mid channel 348 and the decoded frequency-domain side channel 350 to generate the frequency-domain channels 354, 356. In this scenario, the modified IPD parameter values 352 are applied to the decoded frequency-domain mid channel 348 and the decoded frequency-domain side channel 350 during the up-mix operation. The frequency-domain left channel 354 is provided to the inverse transform unit 318, and the frequency-domain right channel 356 is provided to the inverse transform unit 320.

The inverse transform unit 318 is configured to perform a first inverse transform operation on the frequency-domain left channel 354 to generate a time-domain left channel 358. For example, the first inverse transform operation may include an Inverse Discrete Cosine Transform (IDCT) operation, an Inverse Discrete Fourier Transform (IDFT) operation, an Inverse Fast Fourier Transform (IFFT) operation, etc. According to one implementation, the inverse transform unit 318 is configured to perform a synthesis windowing operation on the frequency-domain left channel 354 to generate the time-domain left channel 358. The time-domain left channel 358 is provided to the inter-channel alignment unit 322. The inverse transform unit 320 is configured to perform a second inverse transform operation on the frequency-domain right channel 356 to generate a time-domain right channel 360. For example, the second inverse transform operation may include an IDCT operation, an IDFT operation, an IFFT operation, etc. According to one implementation, the inverse transform unit 320 is configured to perform a synthesis windowing operation on the frequency-domain right channel 356 to generate the time-domain right channel 368. The time-domain right channel 360 is also provided to the inter-channel alignment unit 322.

The ITD parameter value 166 of the stereo parameters 162 is provided to the inter-channel alignment unit 322. According to the illustrated example of FIG. 3, the stereo parameter adjustment unit 312 provides the ITD parameter value 166 to the inter-channel alignment unit 322. In other implementations, the ITD parameter value 166 is provided directly to the inter-channel alignment unit 322. According to one implementation, the inter-channel alignment unit 322 is configured to adjust the time-domain right channel 360 based on the ITD parameter value 166 to generate the right channel 128 and pass the time-domain left channel 358 as the left channel 126. According to another implementation, the inter-channel alignment unit 322 is configured to adjust the time-domain left channel 358 based on the ITD parameter value 166 to generate the left channel 126 and pass the time-domain right channel 360 as the right channel 128.

The decoder 118A may generate channels 126, 128 having reduced artifacts compared to channels that are generated without the modified IPD parameter values 352. For example, to reduce introduction of artifacts that may be caused by decoding IPD parameter values that do not include relevant information (e.g., the IPD parameter values 164), the decoder 118A may modify the IPD parameter values 164 to temporally smooth the irrelevant IPD parameter values 164 that may otherwise cause artifacts.

Figure 4:
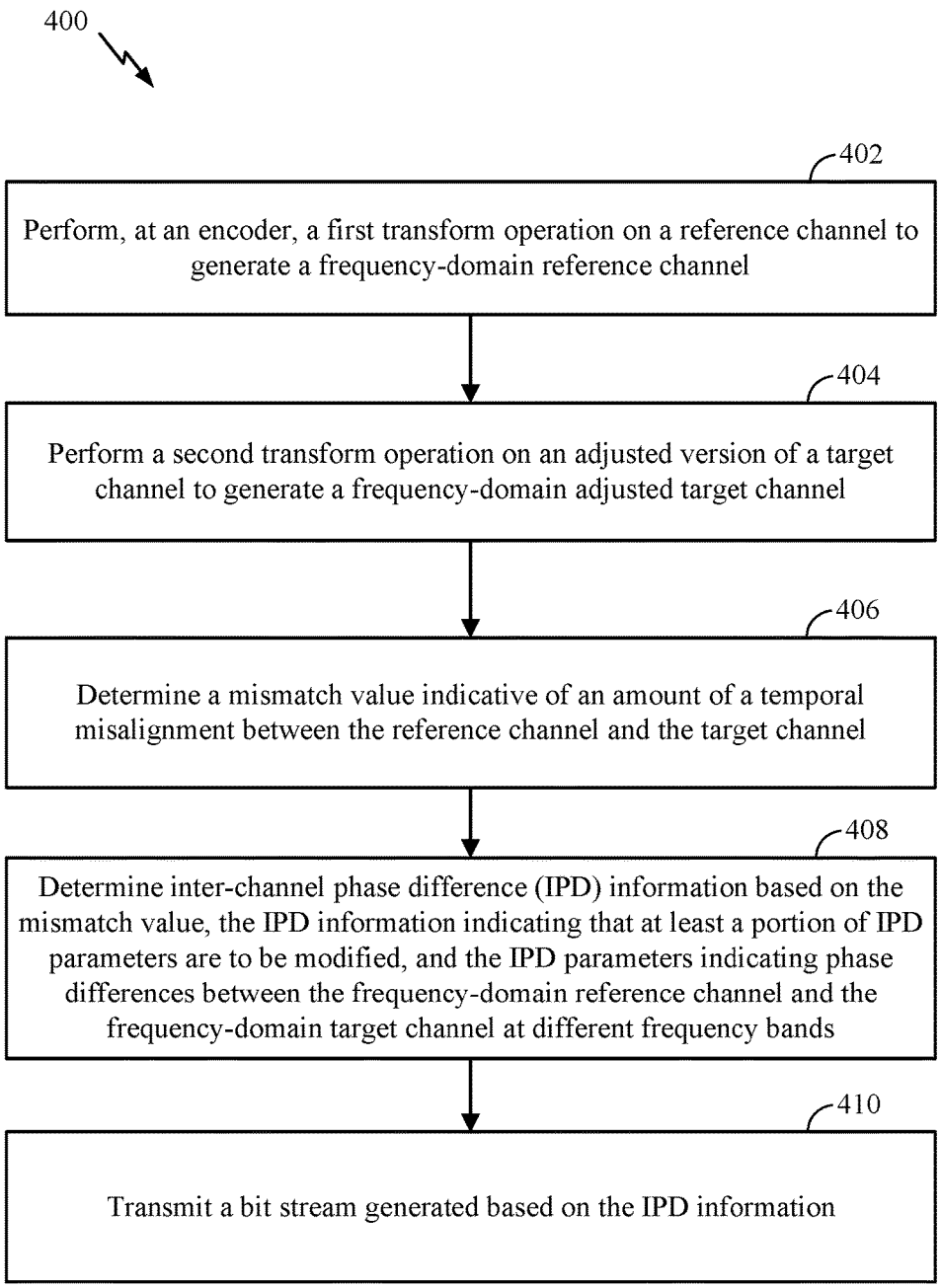
FIG. 4 is a particular example of a method of determining IPD information.

Referring to FIG. 4, a method 400 of determining IPD information in shown. The method 400 may be performed by the first device 104 of FIG. 1, the encoder 114A of FIG. 2, or a combination thereof.

The method 400 includes performing, at an encoder, a first transform operation on a reference channel to generate a frequency-domain reference channel, at 402. For example, referring to FIG. 2, the transform unit 202 performs the first transform operation on the reference channel 130 to generate the frequency-domain reference channel 258.

The method 400 also includes performing a second transform operation on an adjusted version of a target channel to generate a frequency-domain adjusted target channel, at 404. For example, referring to FIG. 2, the transform unit 202 perform the second transform operation on the adjusted target channel 134 (e.g., an adjusted version of the target channel 132 based on the mismatch value 116) to generate the frequency-domain adjusted target channel 256.

The method 400 also includes determining a mismatch value indicative of an amount of temporal misalignment between the reference channel and the target channel, at 406. For example, referring to FIG. 1, the encoder 114 determines the mismatch value 116 indicative of the amount of temporal misalignment between the reference channel 130 and the target channel 132.

The method 400 also includes determining IPD information based on the mismatch value, at 408. The IPD information indicates that at least a portion of IPD parameters are to be modified, and the IPD parameters indicate phase differences between the frequency-domain reference channel and the frequency-domain adjusted target channel at different frequency bands. For example, referring to FIG. 2, the stereo parameter adjustment unit 111 determines that at least a portion of the IPD parameter values 164 are to be modified based on the mismatch value 116.

According to one implementation, the method 400 includes setting one or more of the IPD parameter values 164 to zero values to modify the IPD parameter values 164. According to one implementation, the method 400 includes temporally smoothing one or more of the IPD parameter values 164 to modify the IPD parameter values 164. According to one implementation, the method 400 includes determining that the mismatch value 116 satisfies a first mismatch threshold. The method 400 may also include modifying the IPD parameter values 164 for each frequency band associated with the frequency-domain adjusted target channel 256 in response to determining that the mismatch value 116 satisfies the first mismatch threshold. According to one implementation, the method 400 includes determining that the mismatch value 116 fails to satisfy a second mismatch threshold. The method 400 may also include bypassing modification of the IPD parameter values 164 in response to a determination that the mismatch value 116 fails to satisfy the second mismatch threshold.

According to one implementation, the method 400 includes determining that the mismatch value 116 fails to satisfy the first mismatch value and determining that the mismatch value 116 satisfies the second mismatch value. The method 400 may also include modifying IPD parameter values 164 for a subset of frequency bands associated with the frequency-domain adjusted target channel 256 in response to determining that the mismatch value 116 fails to satisfy the first mismatch threshold and in response to determining that the mismatch value 116 satisfies the second mismatch threshold.

The method 400 also includes transmitting a bitstream based on the IPD information, at 410. For example, referring to FIG. 1, the transmitter 110 may transmit the bitstream to the second device 106.

The method 400 of FIG. 4 may modify IPD parameter values based on the mismatch value 116 to reduce artifacts during decoding stages. For example, to reduce introduction of artifacts that may be caused by decoding IPD parameter values that do not include relevant information, the method 400 may enable generation of IPD information (e.g., one or more flags, IPD parameter values with a pre-defined pattern, IPD parameter values set to zero in low bands) that indicates whether the encoder 114A should modify (e.g., temporally smooth) IPD parameters, indicates which IPD parameters to modify, etc.

Figure 5:
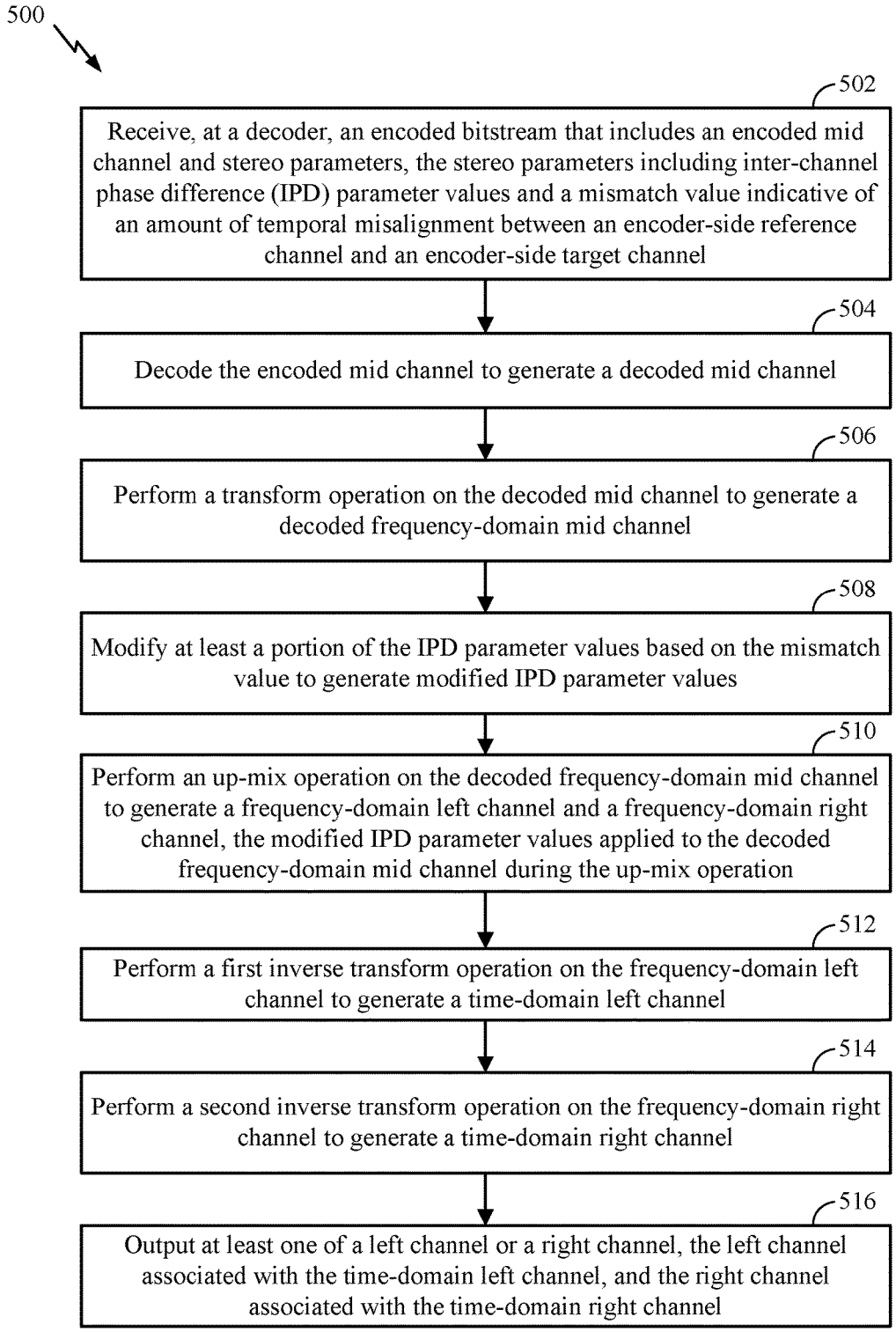
FIG. 5 is a particular example of a method of decoding a bitstream.

Referring to FIG. 5, a method 500 of decoding a bitstream is shown. The method 400 may be performed by the second device 106 of FIG. 1, the decoder 300 of FIG. 3, or a combination thereof.

The method 500 includes receiving, at a decoder, an encoded bitstream that includes an encoded mid channel and stereo parameters, at 502. The stereo parameters include IPD parameter values and a mismatch value indicative of an amount of temporal misalignment between an encoder-side reference channel and an encoder-side target channel. For example, referring to FIG. 1, the receiver 115 receives the bitstream 248 that includes the encoded mid channel 340, the encoded side channel 342, and the stereo parameters 162.

The method 500 also includes decoding the encoded mid channel to generate a decoded mid channel, at 504. For example, referring to FIG. 3, the mid channel decoder 302 decodes the encoded mid channel 340 to generate the decoded mid channel 344. The method 500 also includes performing a transform operation on the decoded mid channel to generate a decoded frequency-domain mid channel, at 506. For example, referring to FIG. 3, the transform unit 306 performs the transform operation on the decoded mid channel 344 to generate the decoded frequency-domain mid channel 348.

The method 500 also includes modifying at least a portion of the IPD parameter values based on the mismatch value to generate modified IPD parameter values, at 508. For example, referring to FIG. 3, the comparison unit 314 compares the absolute value of the mismatch value 116 to a threshold. The modification unit 316 modifies at least a portion of the IPD parameters values 164 to generate modified IPD parameter values 352 in response to a determination that the absolute value of the mismatch value 116 satisfies (e.g., is greater than) the threshold.

The method 500 also include performing an up-mix operation on the decoded frequency-domain mid channel to generate a frequency-domain left channel and a frequency-domain right channel, at 510. The modified IPD parameters are applied to the decoded frequency-domain mid channel during the up-mix operation. For example, referring to FIG. 3, the up-mixer 310 applies the modified IPD parameter values to the decoded frequency-domain mid channel 348 during the up-mix process to generate the frequency-domain left channel 354 and the frequency-domain right channel 356.

The method 500 includes performing a first inverse transform operation on the frequency-domain left channel to generate a time-domain left channel, at 512. For example, referring to FIG. 3, the inverse transform unit 318 performs the first inverse transform operation on the frequency-domain left channel 354 to generate the time-domain left channel 358. The method 500 also includes performing a second inverse transform operation on the frequency-domain right channel to generate a time-domain right channel, at 514. For example, referring to FIG. 3, the inverse transform unit 520 performs the second inverse transform operation on the frequency-domain right channel 356 to generate the time-domain right channel 360.

The method 500 also includes outputting at least one of a left channel or a right channel, at 516. The left channel is associated with the time-domain left channel, and the right channel is associated with the time-domain right channel. For example, referring to FIG. 1, the first loudspeaker 142 outputs the left channel 126 that is associated with the time-domain left channel 358, and the second loudspeaker 144 outputs the right channel 128 that is associated with the time-domain right channel 360.

The method 500 of FIG. 5 may enable generation of channels 126, 128 having reduced artifacts compared to channels that are generated without the modified IPD parameter values 352. For example, to reduce introduction of artifacts that may be caused by decoding IPD parameter values that do not include relevant information (e.g., the IPD parameter values 164), the decoder 118A may modify the IPD parameter values 164 to temporally smooth the irrelevant IPD parameter values 164 that may otherwise cause artifacts.

Figure 6:
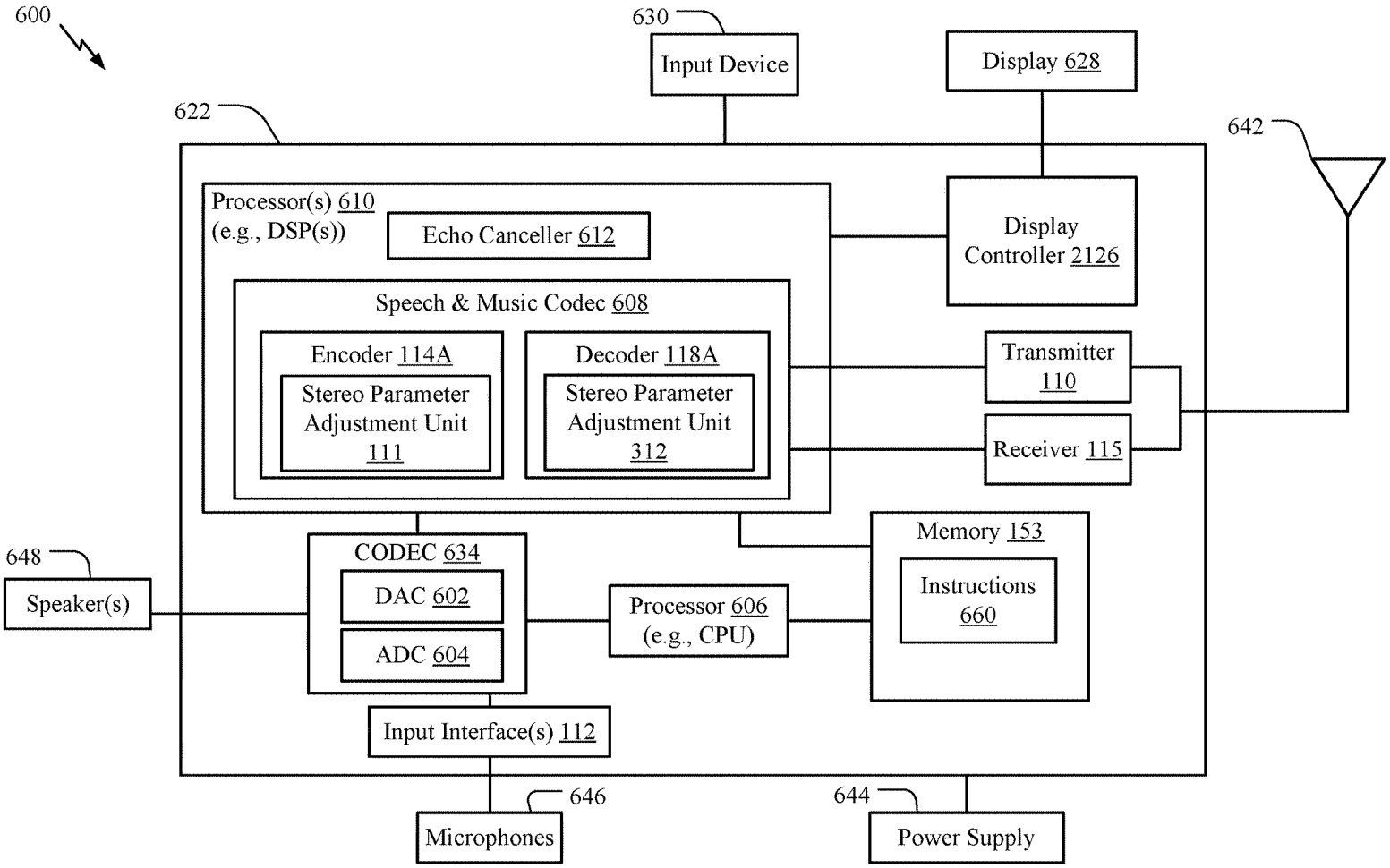
FIG. 6 is a block diagram of a particular illustrative example of a device that includes an encoder operable to modify IPD parameters and a decoder operable to modify IPD parameters.

Referring to FIG. 6, a block diagram of a particular illustrative example of a device (e.g., a wireless communication device) is depicted and generally designated 600. In various implementations, the device 600 may have fewer or more components than illustrated in FIG. 6. In an illustrative implementation, the device 600 may correspond to the first device 104 of FIG. 1, the second device 106 of FIG. 1, or a combination thereof. In an illustrative implementation, the device 600 may perform one or more operations described with reference to systems and methods of FIGS. 1-5.

In a particular implementation, the device 600 includes a processor 606 (e.g., a central processing unit (CPU)). The device 600 includes one or more additional processors 610 (e.g., one or more digital signal processors (DSPs)). The processors 610 include a media (e.g., speech and music) coder-decoder (CODEC) 608, and an echo canceller 612. The media CODEC 608 includes the decoder 118A and the encoder 114A. The encoder 114A includes the stereo parameter adjustment unit 111, and the decoder 118A includes the stereo parameter adjustment unit 312.

The device 600 includes a memory 153 and a CODEC 634. Although the media CODEC 608 is illustrated as a component of the processors 610 (e.g., dedicated circuitry and/or executable programming code), in other implementations one or more components of the media CODEC 608, such as the decoder 118A, the encoder 114A, or a combination thereof, may be included in the processor 606, the CODEC 634, another processing component, or a combination thereof.

The device 600 includes the transmitter 110 and the receiver 115. The transmitter 110 and the receiver 115 are coupled to an antenna 642. The device 600 includes a display 628 coupled to a display controller 626. One or more speakers 648 are coupled to the CODEC 634. One or more microphones 646 are coupled, via the input interface(s) 112, to the CODEC 634. In a particular implementation, the speakers 648 include the first loudspeaker 142, the second loudspeaker 144 of FIG. 1, or a combination thereof. In a particular implementation, the microphones 646 include the first microphone 146, the second microphone 148 of FIG. 1, or a combination thereof. The CODEC 634 includes a digital-to-analog converter (DAC) 602 and an analog-to-digital converter (ADC) 604.

The memory 153 includes instructions 660 executable by the processor 606, the processors 610, the CODEC 634, the encoder 114A, the decoder 118A, another processing unit of the device 600, or a combination thereof, to perform one or more operations described with reference to FIGS. 1-5.

One or more components of the device 600 may be implemented via dedicated hardware (e.g., circuitry), by a processor executing instructions to perform one or more tasks, or a combination thereof. As an example, the memory 153 or one or more components of the processor 606, the processors 610, and/or the CODEC 634 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 660) that, when executed by a computer (e.g., a processor in the CODEC 634, the processor 606, the encoder 114A, the decoder 118A, and/or the processors 610), may cause the computer to perform one or more operations described with reference to FIGS. 1-5. As an example, the memory 153 or the one or more components of the processor 606, the processors 610, the encoder 114A, the decoder 118A, and/or the CODEC 634 may be a non-transitory computer-readable medium that includes instructions (e.g., the instructions 660) that, when executed by a computer (e.g., a processor in the CODEC 634, the processor 606, and/or the processors 610), cause the computer perform one or more operations described with reference to FIGS. 1-5.

In a particular implementation, the device 600 may be included in a system-in-package or system-on-chip device (e.g., a mobile station modem (MSM)) 622. In a particular implementation, the processor 606, the processors 610, the display controller 626, the memory 153, the CODEC 634, the transmitter 110, and the receiver 115 are included in a system-in-package or the system-on-chip device 622. In a particular implementation, an input device 630, such as a touchscreen and/or keypad, and a power supply 644 are coupled to the system-on-chip device 622. Moreover, in a particular implementation, as illustrated in FIG. 6, the display 628, the input device 630, the speakers 648, the microphones 646, the antenna 642, and the power supply 644 are external to the system-on-chip device 622. However, each of the display 628, the input device 630, the speakers 648, the microphones 646, the antenna 642, and the power supply 644 can be coupled to a component of the system-on-chip device 622, such as an interface or a controller.

The device 600 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the techniques disclosed above, an apparatus includes means for receiving an encoded bitstream that includes an encoded mid channel and stereo parameters. The stereo parameters include IPD parameter values and a mismatch value indicative of an amount of misalignment between an encoder-side reference channel and an encoder-side target channel. For example, the means for receiving may include the receiver 115 of FIGS. 1 and 6, the antenna 642 of FIG. 6, other processors, circuits, hardware components, or a combination thereof.

The apparatus also includes means for decoding the encoded mid channel to generate a decoded mid channel. For example, the means for decoding may include the decoder 118 of FIG. 1, the mid channel decoder 302 of FIGS. 1 and 3, the decoder 118A of FIGS. 1 and 6, the processors 610 of FIG. 6, the processor 606 of FIG. 6, the instructions 660 executable by a processor component of FIG. 6, other processors, circuits, hardware components, or a combination thereof.

The apparatus also includes means for performing a transform operation on the decoded mid channel to generate a decoded frequency-domain mid channel. For example, the means for performing the transform operation may include the decoder 118 of FIG. 1, the transform unit 306 of FIGS. 1 and 3, the decoder 118A of FIGS. 1 and 6, the processors 610 of FIG. 6, the processor 606 of FIG. 6, the instructions 660 executable by a processor component of FIG. 6, other processors, circuits, hardware components, or a combination thereof.

The apparatus also includes means for modifying at least a portion of the IPD parameter values based on the mismatch value to generate modified IPD parameter values. For example, the means for modifying may include the decoder 118 of FIG. 1, the stereo parameter adjustment unit 312 of FIGS. 1, 3, and 6, the decoder 118A of FIGS. 1 and 6, the processors 610 of FIG. 6, the processor 606 of FIG. 6, the instructions 660 executable by a processor component of FIG. 6, other processors, circuits, hardware components, or a combination thereof.

The apparatus also includes means for performing an up-mix operation on the decoded frequency-domain mid channel to generate a frequency-domain left channel and a frequency-domain right channel. The modified IPD parameter values are applied to the decoded frequency-domain mid channel during the up-mix operation. For example, the means for performing the up-mix operation may include the decoder 118 of FIG. 1, the up-mixer 310 of FIGS. 1 and 3, the decoder 118A of FIGS. 1 and 6, the processors 610 of FIG. 6, the processor 606 of FIG. 6, the instructions 660 executable by a processor component of FIG. 6, other processors, circuits, hardware components, or a combination thereof.

The apparatus also includes means for performing a first inverse transform operation on the frequency-domain left channel to generate a time-domain left channel. For example, the means for performing the first inverse transform operation may include the decoder 118 of FIG. 1, the inverse transform unit 318 of FIGS. 1 and 3, the decoder 118A of FIGS. 1 and 6, the processors 610 of FIG. 6, the processor 606 of FIG. 6, the instructions 660 executable by a processor component of FIG. 6, other processors, circuits, hardware components, or a combination thereof.

The apparatus also includes means for performing a second inverse transform operation on the frequency-domain right channel to generate a time-domain right channel. For example, the means for performing the second inverse transform operation may include the decoder 118 of FIG. 1, the inverse transform unit 320 of FIGS. 1 and 3, the decoder 118A of FIGS. 1 and 6, the processors 610 of FIG. 6, the processor 606 of FIG. 6, the instructions 660 executable by a processor component of FIG. 6, other processors, circuits, hardware components, or a combination thereof.

The apparatus also includes means for outputting at least one of a left channel or a right channel, the left channel associated with the time-domain left channel, and the right channel associated with the time-domain right channel. For example, the means for outputting may include the first loudspeaker 142 of FIG. 1, the second loudspeaker 144 of FIG. 1, the speakers 648 of FIG. 6, other processors, circuits, hardware components, or a combination thereof.

Figure 7:
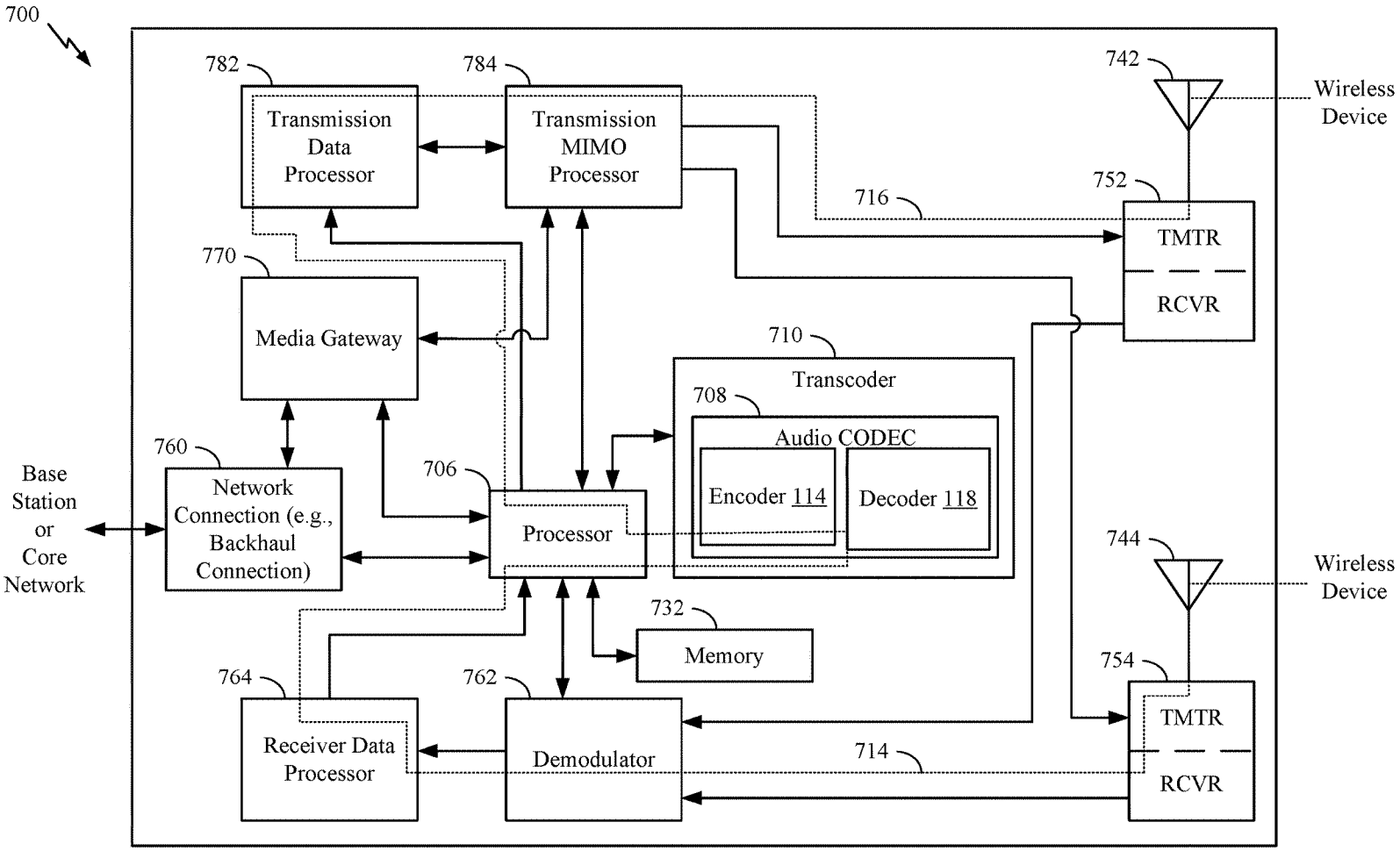
FIG. 7 is a block diagram of a particular illustrative example of a base station that includes an encoder operable to modify IPD parameters and a decoder operable to modify IPD parameters.

Referring to FIG. 7, a block diagram of a particular illustrative example of a base station 700 is depicted. In various implementations, the base station 700 may have more components or fewer components than illustrated in FIG. 7. In an illustrative example, the base station 700 may operate according to the method 400 of FIG. 4, the method 500 of FIG. 5, or both.

The base station 700 may be part of a wireless communication system. The wireless communication system may include multiple base stations and multiple wireless devices. The wireless communication system may be a Long Term Evolution (LTE) system, a fourth generation (4G) LTE system, a fifth generation (5G) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 600 of FIG. 6.

Various functions may be performed by one or more components of the base station 700 (and/or in other components not shown), such as sending and receiving messages and data (e.g., audio data). In a particular example, the base station 700 includes a processor 706 (e.g., a CPU). The base station 700 may include a transcoder 710. The transcoder 710 may include an audio CODEC 708 (e.g., a speech and music CODEC). For example, the transcoder 710 may include one or more components (e.g., circuitry) configured to perform operations of the audio CODEC 708. As another example, the transcoder 710 is configured to execute one or more computer-readable instructions to perform the operations of the audio CODEC 708. Although the audio CODEC 708 is illustrated as a component of the transcoder 710, in other examples one or more components of the audio CODEC 708 may be included in the processor 706, another processing component, or a combination thereof. For example, the decoder 118 (e.g., a vocoder decoder) may be included in a receiver data processor 764. As another example, the encoder 114 (e.g., a vocoder encoder) may be included in a transmission data processor 782.

The transcoder 710 may function to transcode messages and data between two or more networks. The transcoder 710 is configured to convert message and audio data from a first format (e.g., a digital format) to a second format. To illustrate, the decoder 118 may decode encoded signals having a first format and the encoder 114 may encode the decoded signals into encoded signals having a second format. Additionally or alternatively, the transcoder 710 is configured to perform data rate adaptation. For example, the transcoder 710 may downconvert a data rate or upconvert the data rate without changing a format of the audio data. To illustrate, the transcoder 710 may downconvert 64 kbit/s signals into 16 kbit/s signals. The audio CODEC 708 may include the encoder 114 and the decoder 118. The decoder 118 may include the stereo parameter conditioner 618.

The base station 700 includes a memory 732. The memory 732 (an example of a computer-readable storage device) may include instructions. The instructions may include one or more instructions that are executable by the processor 706, the transcoder 710, or a combination thereof, to perform the method 400 of FIG. 4, the method 500 of FIG. 5, or both. The base station 700 may include multiple transmitters and receivers (e.g., transceivers), such as a first transceiver 752 and a second transceiver 754, coupled to an array of antennas. The array of antennas may include a first antenna 742 and a second antenna 744. The array of antennas is configured to wirelessly communicate with one or more wireless devices, such as the device 600 of FIG. 6. For example, the second antenna 744 may receive a data stream 714 (e.g., a bitstream) from a wireless device. The data stream 714 may include messages, data (e.g., encoded speech data), or a combination thereof.

The base station 700 may include a network connection 760, such as a backhaul connection. The network connection 760 is configured to communicate with a core network or one or more base stations of the wireless communication network. For example, the base station 700 may receive a second data stream (e.g., messages or audio data) from a core network via the network connection 760. The base station 700 may process the second data stream to generate messages or audio data and provide the messages or the audio data to one or more wireless devices via one or more antennas of the array of antennas or to another base station via the network connection 760. In a particular implementation, the network connection 760 may be a wide area network (WAN) connection, as an illustrative, non-limiting example. In some implementations, the core network may include or correspond to a Public Switched Telephone Network (PSTN), a packet backbone network, or both.

The base station 700 may include a media gateway 770 that is coupled to the network connection 760 and the processor 706. The media gateway 770 is configured to convert between media streams of different telecommunications technologies. For example, the media gateway 770 may convert between different transmission protocols, different coding schemes, or both. To illustrate, the media gateway 770 may convert from PCM signals to Real-Time Transport Protocol (RTP) signals, as an illustrative, non-limiting example. The media gateway 770 may convert data between packet switched networks (e.g., a Voice Over Internet Protocol (VoIP) network, an IP Multimedia Subsystem (IMS), a fourth generation (4G) wireless network, such as LTE, WiMax, and UMB, a fifth generation (5G) wireless network, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 770 may include a transcoder, such as the transcoder 710, and is configured to transcode data when codecs are incompatible. For example, the media gateway 770 may transcode between an Adaptive Multi-Rate (AMR) codec and a G.711 codec, as an illustrative, non-limiting example. The media gateway 770 may include a router and a plurality of physical interfaces. In some implementations, the media gateway 770 may also include a controller (not shown). In a particular implementation, the media gateway controller may be external to the media gateway 770, external to the base station 700, or both. The media gateway controller may control and coordinate operations of multiple media gateways. The media gateway 770 may receive control signals from the media gateway controller and may function to bridge between different transmission technologies and may add service to end-user capabilities and connections.

The base station 700 may include a demodulator 762 that is coupled to the transceivers 752, 754, the receiver data processor 764, and the processor 706, and the receiver data processor 764 may be coupled to the processor 706. The demodulator 762 is configured to demodulate modulated signals received from the transceivers 752, 754 and to provide demodulated data to the receiver data processor 764. The receiver data processor 764 is configured to extract a message or audio data from the demodulated data and send the message or the audio data to the processor 706.

The base station 700 may include a transmission data processor 782 and a transmission multiple input-multiple output (MIMO) processor 784. The transmission data processor 782 may be coupled to the processor 706 and to the transmission MIMO processor 784. The transmission MIMO processor 784 may be coupled to the transceivers 752, 754 and the processor 706. In some implementations, the transmission MIMO processor 784 may be coupled to the media gateway 770. The transmission data processor 782 is configured to receive the messages or the audio data from the processor 706 and to code the messages or the audio data based on a coding scheme, such as CDMA or orthogonal frequency-division multiplexing (OFDM), as an illustrative, non-limiting examples. The transmission data processor 782 may provide the coded data to the transmission MIMO processor 784.

The coded data may be multiplexed with other data, such as pilot data, using CDMA or OFDM techniques to generate multiplexed data. The multiplexed data may then be modulated (i.e., symbol mapped) by the transmission data processor 782 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 706.

The transmission MIMO processor 784 is configured to receive the modulation symbols from the transmission data processor 782 and may further process the modulation symbols and may perform beamforming on the data. For example, the transmission MIMO processor 784 may apply beamforming weights to the modulation symbols.

During operation, the second antenna 744 of the base station 700 may receive a data stream 714. The second transceiver 754 may receive the data stream 714 from the second antenna 744 and may provide the data stream 714 to the demodulator 762. The demodulator 762 may demodulate modulated signals of the data stream 714 and provide demodulated data to the receiver data processor 764. The receiver data processor 764 may extract audio data from the demodulated data and provide the extracted audio data to the processor 706.

The processor 706 may provide the audio data to the transcoder 710 for transcoding. The decoder 118 of the transcoder 710 may decode the audio data from a first format into decoded audio data, and the encoder 114 may encode the decoded audio data into a second format. In some implementations, the encoder 114 may encode the audio data using a higher data rate (e.g., upconvert) or a lower data rate (e.g., downconvert) than received from the wireless device. In other implementations, the audio data may not be transcoded. Although transcoding (e.g., decoding and encoding) is illustrated as being performed by a transcoder 710, the transcoding operations (e.g., decoding and encoding) may be performed by multiple components of the base station 700. For example, decoding may be performed by the receiver data processor 764 and encoding may be performed by the transmission data processor 782. In other implementations, the processor 706 may provide the audio data to the media gateway 770 for conversion to another transmission protocol, coding scheme, or both. The media gateway 770 may provide the converted data to another base station or core network via the network connection 760.

Encoded audio data generated at the encoder 114, such as transcoded data, may be provided to the transmission data processor 782 or the network connection 760 via the processor 706. The transcoded audio data from the transcoder 710 may be provided to the transmission data processor 782 for coding according to a modulation scheme, such as OFDM, to generate the modulation symbols. The transmission data processor 782 may provide the modulation symbols to the transmission MIMO processor 784 for further processing and beamforming. The transmission MIMO processor 784 may apply beamforming weights and may provide the modulation symbols to one or more antennas of the array of antennas, such as the first antenna 742 via the first transceiver 752. Thus, the base station 700 may provide a transcoded data stream 716, that corresponds to the data stream 714 received from the wireless device, to another wireless device. The transcoded data stream 716 may have a different encoding format, data rate, or both, than the data stream 714. In other implementations, the transcoded data stream 716 may be provided to the network connection 760 for transmission to another base station or a core network.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising:

a receiver configured to receive an encoded bitstream that includes an encoded mid channel and stereo parameters, the stereo parameters including inter-channel phase difference (IPD) parameter values and a mismatch value indicative of an amount of temporal misalignment between an encoder-side reference channel and an encoder-side target channel;

a mid channel decoder configured to decode the encoded mid channel to generate a decoded mid channel;

a transform unit configured to perform a transform operation on the decoded mid channel to generate a decoded frequency-domain mid channel;

a stereo parameter adjustment unit configured to modify at least a portion of the IPD parameter values based on the mismatch value to generate modified IPD parameter values;

an up-mixer configured to perform an up-mix operation on the decoded frequency-domain mid channel to generate a frequency-domain left channel and a frequency-domain right channel, the modified IPD parameter values applied to the decoded frequency-domain mid channel during the up-mix operation;

a first inverse transform unit configured to perform a first inverse transform operation on the frequency-domain left channel to generate a time-domain left channel; and a second inverse transform unit configured to perform a second inverse transform operation on the frequency-domain right channel to generate a time-domain right channel.

2. The device of claim 1, wherein the stereo parameter adjuster unit is configured to:

compare an absolute value of the mismatch value to a threshold; and modify at least the portion of the IPD parameter values in response to a determination that the absolute value of the mismatch value satisfies the threshold.

3. The device of claim 1, further comprising:

one or more speakers configured to output at least one of a left channel or a right channel, the left channel associated with the time-domain left channel, and the right channel associated with the time-domain right channel.

4. The device of claim 3, wherein the stereo parameters include an inter-channel time difference (ITD) parameter value as the mismatch value, and further comprising:

an inter-channel alignment unit configured to:

adjust the time-domain right channel based on the ITD parameter value to generate the right channel; or adjust the time-domain left channel based on the ITD parameter value to generate the left channel.

5. The device of claim 4, wherein the inter-channel alignment unit is included in the up-mixer.

6. The device of claim 1, further comprising:

a side channel decoder configured to decode an encoded side channel to generate a decoded side channel, the encoded side channel included in the encoded bitstream; and a second transform unit configured to perform a second transform operation on the decoded side channel to generate a decoded frequency-domain side channel.

7. The device of claim 6, wherein the stereo parameter adjustment unit is further configured to modify the IPD parameter values based on an availability of the encoded side channel.

8. The device of claim 1, wherein the stereo parameter adjustment unit is further configured to modify the IPD parameter values based on a bit rate associated with the encoded bitstream.

9. The device of claim 1, wherein the stereo parameter adjustment unit is further configured to modify the IPD parameter values based on a voicing parameter, a packet loss determination associated with a previous frame, a speech/music classification, or another parameter.

10. The device of claim 1, wherein the stereo parameter adjustment unit is configured to set one or more of the IPD parameter values to zero values.

11. The device of claim 1, wherein the stereo parameter adjustment unit is configured to temporally smooth one or more of the IPD parameter values.

12. The device of claim 1, wherein the mismatch value indicates the amount of temporal misalignment in a frequency domain.

13. The device of claim 1, wherein the mismatch value indicates the amount of temporal misalignment in a time domain.

14. The device of claim 1, wherein the stereo parameter adjustment unit is integrated into a mobile device.

15. The device of claim 1, wherein the stereo parameter adjustment unit is integrated into a base station.

16. A method of decoding audio channels, the method comprising:

receiving, at a decoder, an encoded bitstream that includes an encoded mid channel and stereo parameters, the stereo parameters including inter-channel phase difference (IPD) parameter values and a mismatch value indicative of an amount of temporal misalignment between an encoder-side reference channel and an encoder-side target channel;

decoding the encoded mid channel to generate a decoded mid channel;

performing a transform operation on the decoded mid channel to generate a decoded frequency-domain mid channel;

modifying at least a portion of the IPD parameter values based on the mismatch value to generate modified IPD parameter values;

performing an up-mix operation on the decoded frequency-domain mid channel to generate a frequency-domain left channel and a frequency-domain right channel, the modified IPD parameter values applied to the decoded frequency-domain mid channel during the up-mix operation;

performing a first inverse transform operation on the frequency-domain left channel to generate a time-domain left channel; and performing a second inverse transform operation on the frequency-domain right channel to generate a time-domain right channel.

17. The method of claim 16, wherein modifying at least the portion of the IPD parameter values comprises:

comparing an absolute value of the mismatch value to a threshold; and modifying at least the portion of the IPD parameter values in response to a determination that the absolute value of the mismatch value satisfies the threshold.

18. The method of claim 16, further comprising outputting at least one of a left channel or a right channel, the left channel associated with the time-domain left channel, and the right channel associated with the time-domain right channel.

19. The method of claim 18, wherein the stereo parameters include an inter-channel time difference (ITD) parameter value as the mismatch value, and further comprising:

adjusting the time-domain right channel based on the ITD parameter value to generate the right channel; or adjusting the time-domain left channel based on the ITD parameter value to generate the left channel.

20. The method of claim 16, further comprising:

decoding an encoded side channel to generate a decoded side channel, the encoded side channel included in the encoded bitstream; and performing a second transform operation on the decoded side channel to generate a decoded frequency-domain side channel.

21. The method of claim 20, further comprising modifying the IPD parameter values based on an availability of the encoded side channel.

22. The method of claim 16, further comprising modifying the IPD parameter values based on a bit rate associated with the encoded bitstream.

23. The method of claim 16, further comprising setting one or more of the IPD parameter values to zero values.

24. The method of claim 16, further comprising temporally smoothing one or more of the IPD parameter values.

25. The method of claim 16, wherein the mismatch value indicates the amount of temporal misalignment in a frequency domain.

26. The method of claim 16, wherein the mismatch value indicates the amount of temporal misalignment in a time domain.

27. The method of claim 16, wherein modifying at least the portion of the IPD parameter values is performed at a mobile device.

28. The method of claim 16, wherein modifying at least the portion of the IPD parameter values is performed at a base station.

29. A non-transitory computer-readable medium comprising instructions that, when executed by a processor within a decoder, cause the processor to perform operations comprising:

decoding an encoded mid channel to generate a decoded mid channel, the encoded mid channel included in an encoded bitstream received by the decoder, the encoded bitstream further comprising stereo parameters that include inter-channel phase difference (IPD) parameter values and a mismatch value indicative of an amount of temporal misalignment between an encoder-side reference channel and an encoder-side target channel;

performing a transform operation on the decoded mid channel to generate a decoded frequency-domain mid channel;

modifying at least a portion of the IPD parameter values based on the mismatch value to generate modified IPD parameter values;

performing an up-mix operation on the decoded frequency-domain mid channel to generate a frequency-domain left channel and a frequency-domain right channel, the modified IPD parameter values applied to the decoded frequency-domain mid channel during the up-mix operation;

performing a first inverse transform operation on the frequency-domain left channel to generate a time-domain left channel; and performing a second inverse transform operation on the frequency-domain right channel to generate a time-domain right channel.

30. The non-transitory computer-readable medium of claim 29, wherein modifying at least the portion of the IPD parameter values comprises:

comparing an absolute value of the mismatch value to a threshold; and modifying at least the portion of the IPD parameter values in response to a determination that the absolute value of the mismatch value satisfies the threshold.

31. The non-transitory computer-readable medium of claim 29, wherein the operations further comprise providing at least one of a left channel or a right channel to one or more speakers, the left channel associated with the time-domain left channel, and the right channel associated with the time-domain right channel.

32. An apparatus comprising:

means for receiving an encoded bitstream that includes an encoded mid channel and stereo parameters, the stereo parameters including inter-channel phase difference (IPD) parameter values and a mismatch value indicative of an amount of temporal misalignment between an encoder-side reference channel and an encoder-side target channel;

means for decoding the encoded mid channel to generate a decoded mid channel;

means for performing a transform operation on the decoded mid channel to generate a decoded frequency-domain mid channel;

means for modifying at least a portion of the IPD parameter values based on the mismatch value to generate modified IPD parameter values;

means for performing an up-mix operation on the decoded frequency-domain mid channel to generate a frequency-domain left channel and a frequency-domain right channel, the modified IPD parameter values applied to the decoded frequency-domain mid channel during the up-mix operation;

means for performing a first inverse transform operation on the frequency-domain left channel to generate a time-domain left channel; and means for performing a second inverse transform operation on the frequency-domain right channel to generate a time-domain right channel.

33. The apparatus of claim 32, further comprising means for outputting a left channel and a right channel, the left channel associated with the time-domain left channel, and the right channel associated with the time-domain right channel.

34. The apparatus of claim 32, wherein the means for modifying is integrated into a base station.

35. The apparatus of claim 32, wherein the means for modifying is integrated into a mobile device.

* * * * *